United States Patent [19]

Gimple

[11] 3,964,683

[45] June 22, 1976

[54] ELECTROSTATIC SPRAY APPARATUS

[75] Inventor: James J. Gimple, Toledo, Ohio

[73] Assignee: Champion Spark Plug Company, Toledo, Ohio

[22] Filed: Sept. 2, 1975

[21] Appl. No.: 609,669

[52] U.S. Cl. ..... 239/15; 239/105

[51] Int. Cl.[2] ..... B05B 5/02; B05B 1/28

[58] Field of Search ..... 239/3, 15, 63, 64, 105

[56] References Cited

UNITED STATES PATENTS

| | | | |
|---|---|---|---|
| 2,916,576 | 12/1959 | Croskey et al. | 239/15 X |
| 3,691,991 | 9/1972 | Luderer et al. | 239/15 X |
| 3,740,612 | 6/1973 | Gauthier et al. | 239/15 X |
| 3,746,254 | 7/1973 | Duncan et al. | 239/15 |

*Primary Examiner*—Robert S. Ward, Jr.
*Attorney, Agent, or Firm*—Oliver E. Todd, Jr.

[57] ABSTRACT

An improved electrostatic spray gun for the deposition of powdered coating material on a workpiece is disclosed. The spray gun includes a housing having a barrel to which a nozzle is attached for directing the powdered material to the workpiece. A charging electrode, which is connected to a high voltage power supply, is mounted on a diffuser assembly which is clamped between the nozzle and the housing, on which the nozzle is threaded. A regulated gas flow supplied through the housing and the diffuser assembly provides a gas shield around the charging electrode to prevent a buildup of the coating material on the electrode. A novel pneumatic safety interlock continuously monitors the pressure of the gas supplied to the diffuser assembly. The interlock turns off the high voltage power supply and a pump for the coating material in response to a drop in such pressure resulting from a loose nozzle.

7 Claims, 5 Drawing Figures

ELECTROSTATIC SPRAY APPARATUS

BACKGROUND OF THE INVENTION

Spray guns for the electrostatic deposition of powder coating material generally includes a housing having a barrel through which a gas-borne or fluidized stream of the solid particulate coating material flows to an attached nozzle or spray cap. The material is electrostatically charged as it passes through the nozzle and is subsequently directed toward a workpiece which is to be coated with the material. The material is charged by means of an electrode which is connected to a high voltage power supply. In a preferred design, the charging electrode is in the form of a needle located in the center of the material flow path through the nozzle. When a high voltage is applied between the workpiece and the needle electrode, the resulting electrostatic field around the electrode charges the material as it flows through the nozzle. A diffuser assembly, which supports the needle electrode, is clamped between the barrel and the nozzle, which screws onto the barrel.

It is generally desirable to have an electrically insulating nozzle extend past the electrode to prevent an accidental shorting of the electrode to the workpiece or to any other grounded object and to reduce the chance of electrical shock for the spray gun operator. It is also desirable to removably attach the nozzle to the spray gun barrel to facilitate maintenance such as cleaning the nozzle. Typically, the nozzle is threaded onto the barrel. However, there is a danger that the nozzle will loosen during use, particularly when the spray gun operator is careless in tightening the nozzle. If the nozzle should loosen beyond a predetermined point, a potential spark path will be produced from some portion of the gun charging circuit to some electrically grounded object. This spark path is dangerous to the operator and also increases the risk of a spark which is particularly hazardous since many fluidized powdered coating materials are potentially explosive.

SUMMARY OF THE INVENTION

According to the present invention, a spray gun is provided with a novel pneumatically operated interlock which turns off the high voltage power supply when the nozzle becomes loose on the gun barrel. Preferably, the delivery of coating material to the spray gun is also interrupted by the interlock. Compressed gas at a regulated pressure is applied to the spray gun. The gas passes through a hose in the gun to the nozzle, where its flow is normally blocked. However, when the nozzle is loosened, sufficient gas is permitted to escape between the nozzle and the barrel to cause a decrease in gas pressure at the spray gun. This decrease in pressure is sensed by a pneumatic valve or switch which turns off at least the high voltage power supply. With the high voltage to the charging electrode interrupted, there is no danger of shock or of an explosion. In addition to turning off the power supply, the pneumatic valve or switch may also be connected to turn off a powder pump which supplies the fluidized powdered coating material to the spray gun and to turn off any vortex gas supply which controls the pattern size and shape of the powder spray.

In a preferred embodiment of the invention, the charging electrode is in the form of a needle. The needle electrode is mounted in a diffuser assembly which is clamped between the nozzle and the spray gun barrel.

A limited flow of the compressed gas for the interlock is also used to establish a gas shield about the needle electrode to prevent powder buildup on the electrode. The quantity of gas needed for establishing an adequate gas shield for the electrode is sufficiently small that it does not appreciably reduce the gas pressure at the spray gun as long as the nozzle is attached tightly to the spray gun barrel. If the nozzle should become loosened, the resulting gas flow between the nozzle and the barrel is sufficient to cause an appreciable pressure drop which operates a pneumatic valve or switch for turning off at least the high voltage power supply. Other controls, such as a powder pump and a vortex gas supply, may also be turned off to completely shut off the spray gun when the nozzle comes loose.

When the spray gun is of a portable, hand-held design, a trigger controlled regulator valve is mounted in the spray gun. This valve may be located between the compressed gas source and the pneumatic valve for the interlock. Releasing the trigger closes the regulator valve to interrupt gas pressure to the pneumatic interlock valve. This in turn shuts off the electricity and powder flow to the hand gun. When the trigger is squeezed, the hand gun is turned on, unless the nozzle is loose or removed from the barrel.

Accordingly, it is an object of the invention to provide a safety interlock for electrostatic powder coating apparatus.

Another object of the invention is to provide a safety interlock for an electrostatic spray gun responsive to the loosening of a nozzle which is releasably attached to a barrel on the spray gun.

Still another object of the invention is to provide a safety interlock for an electrostatic powder spray gun for turning off at least a high voltage power supply in the event that a nozzle on the spray gun becomes loose.

Other objects and advantages of the invention will become apparent from the following detailed description, with reference being made to the accompanying drawings.

DESCRIPTION OF THE PREFERRED EMBODIMENT

Figure 1:
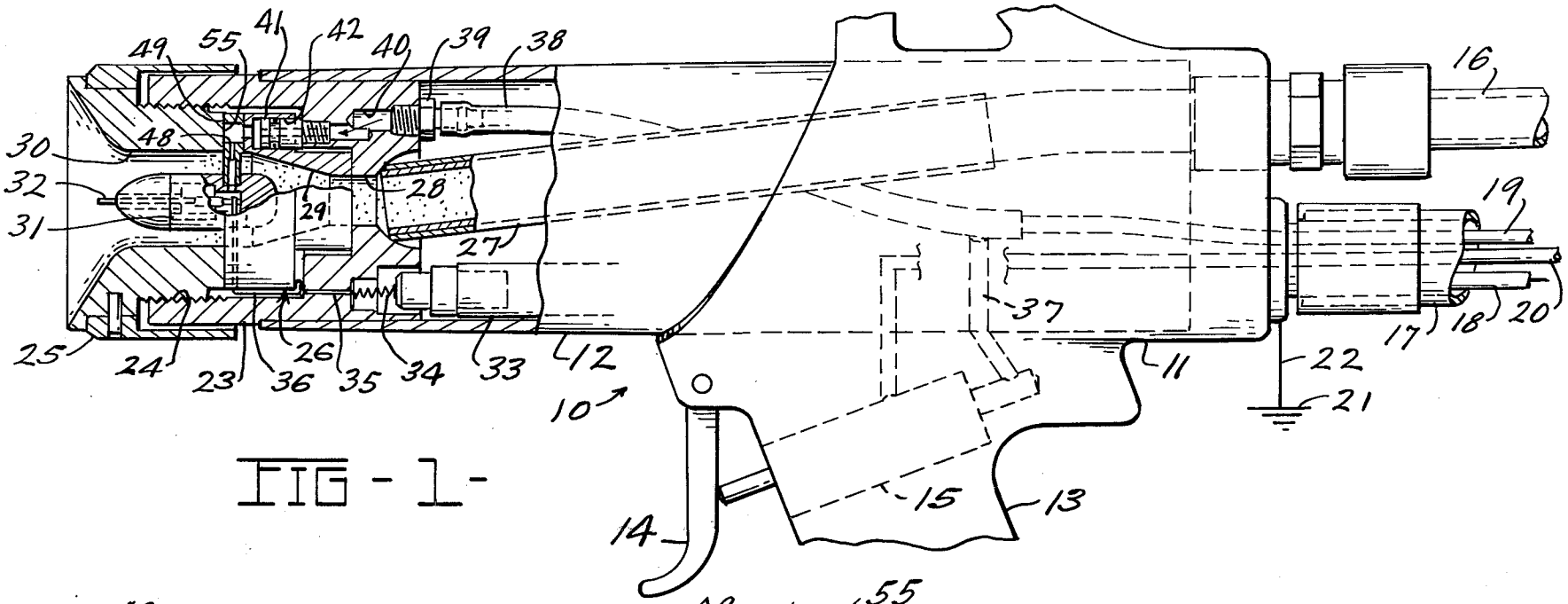
FIG. 1 is a fragmentary side elevational view, in partial section, of an electrostatic hand gun for the deposition of powdered material on a workpiece in accordance with a preferred embodiment of the invention.

Turning now to the drawings, and particularly to FIG. 1, a hand gun 10 is shown in fragment and partial section for the electrostatic deposition of a powdered coating material on a workpiece (not shown). The hand gun 10 has a housing consisting of a rear housing section 11 and an electrically insulated barrel 12. The rear housing section 11 includes an integral handle 13 which carries a trigger 14 and mounts a trigger actuated regulator valve 15. A powder hose 16 and a conduit 17 are attached to the rear housing section 11. A gas-borne or fluidized stream of powdered coating material is delivered through the powder hose 16 to the hand gun 10 from a suitable remote source (not shown) such as a powder pump submerged in a fluidized bed of powdered coating material. The conduit 17 carries a high voltage cable 18 which supplies a high voltage to the hand gun 10 for electrostatically charging the coating material, a regulated gas inlet hose 19 and an interlock and control gas hose 20. The conduit 17 may also carry other hoses and control lines. For example, a hose may be provided in the conduit 17 for supplying vortex gas to the hand gun 10 for controlling the pattern of the sprayed or discharged powdered coating material. A connection is also made between the rear housing section 11 and electrical ground 21 by means of a ground wire 22.

The barrel 12 of the hand gun 10 terminates at a front section 23 which has a threaded portion 24 to which a spray cap or nozzle 25 is attached. A diffuser assembly 26 is clamped between the front barrel section 23 and the nozzle 25. Suitable connections are made in the hand gun 10 from the hose 16 and the conduit 17 through the barrel 12 to the nozzle 25 and to the trigger actuated regulator valve 15. A hose 27 is connected between the powder hose 16 and a passage 28 in the front barrel section 23 for directing the fluidized powdered coating material into such passage 28. The passage 28 is aligned with a passage 29 in the diffuser assembly 26. The diffuser assembly passage 29 has an increasing diameter for alignment with an enlarged diameter passage 30 through the nozzle 25. The diffuser assembly 26 includes a generally cylindrical member 31 which is held centered coaxially in the nozzle passage 30. The member 31 mounts a needle shaped charging electrode 32 which projects from the downstream side of the member 31 into the nozzle passage 30.

The high voltage cable 18 is connected to a resistor tube 33 located within the barrel 12. The resistor tube 33 is preferably sealed in epoxy or some other suitable dielectric material and has an extremely high resistance, on the order of perhaps 100 megohms, or more. The resistor tube 33 is connected through a suitable spring 34 and a contact 35 to a contact 36 on the diffuser assembly 26. The contact 36 is connected to the needle electrode 32 to complete a series connection from the high voltage cable 18 through the resistor tube 33 to the needle electrode 32. As the fluidized powdered coating material flows from the powder hose 16 connected to the remote source through the powder hose 27, the passages 28, 29 and 30, and is emitted from the nozzle 25, the needle electrode 32 imparts a strong static charge to the particulate material. The nozzle 25 is shaped to provide a desired pattern to the emitted particulate material. Although not shown in the drawings, vortex gas may also be supplied to passages in the nozzle 25 for controlling or modifying the pattern of the sprayed particulate coating material.

Figure 2:
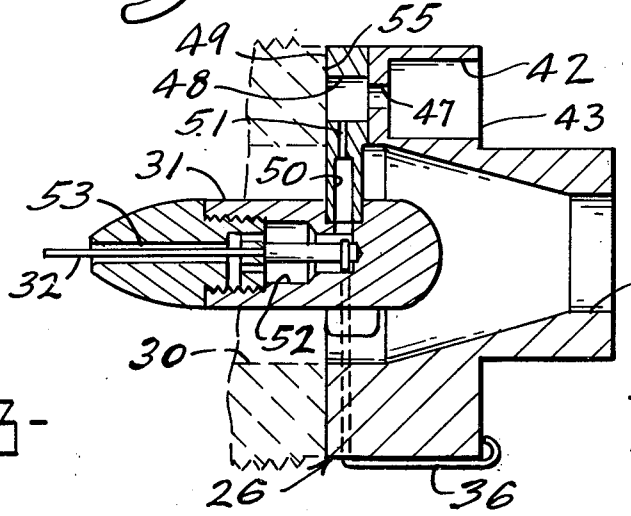
FIG. 2 is an enlarged cross-sectional view of a diffuser assembly mounting a needle electrode for use in the hand gun of FIG. 1.
Figure 3:
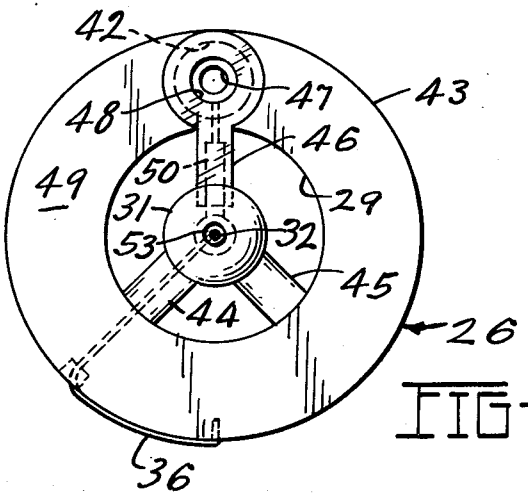
FIG. 3 is a front elevational view of the diffuser assembly of FIG. 2.

The regulator gas inlet hose 19 in the conduit 17 is connected through a hose 37 to the trigger regulator valve 15 and through a hose 38 to the front barrel section 23 for supplying gas to the diffuser assembly 26 for forming a gas shield about the needle electrode 32. The gas hose 38 is connected through a fitting 39 to a passage 40 in the front barrel section 23. The passage 40 is terminated at a fitting 41 which engages a cooperating opening 42 in the diffuser assembly 26. As best shown in FIGS. 2 and 3, the diffuser assembly 26 has an annular outer portion 43 which is clamped between the nozzle 25 and the front barrel section 23 to hold the diffuser assembly 26 in place. The passage 29 forms the interior opening through the support member 43. Three radially oriented spokes 44, 45 and 46 extend inwardly into the passage 29 for supporting the cylindrical member 31. The contact 36 extends from the outer surface of the support member 43 through one of the spokes 44 into the member 31 and is electrically connected to the needle electrode 32. The opening 42 in the support member 43 is connected through an opening 47 and a chamber 48 which extends to a front surface 49 on the support member 43. The chamber 48 is connected through a passage 50 having a restricted portion 51 to a chamber 52 within the member 31. The chamber 52 is in turn connected to an annnular passage 53 which surrounds the needle electrode 32. When compressed gas is supplied through the regulated gas inlet hose 19, the hose 38, the passage 40, the fitting 41 and the passage 47, the chamber 48, the passage 50 and the chamber 52 to the annular passage 53, a gas curtain or shield is established around the electrode 32. The restricted portion 51 in the passage 50 limits the quantity of gas forming the gas shield. The gas shield should be of such a velocity to prevent a buildup of the powdered coating material on the end of the needle electrode 32 extending from the member 31. However, the quantity of gas forming the shield should remain sufficiently small as not to affect the shape of the pattern formed by the particulate coating material discharged from the nozzle 25.

As previously indicated, the regulated gas inlet hose 19 is also connected through a hose 37 to the trigger controlled regulator valve 15. As the trigger 14 is squeezed by the finger of an operator, the valve 15 is opened to connect the hose 37 to the interlock and control gas hose 20. As is described in greater detail below, when the hose 37 is connected to the hose 20, the gas pressure in the hose 38 is applied over the hose 20 to a control circuit which in turn energizes a high voltage power supply for applying high voltage on the cable 18 and also, energizes a powder pump to pump fluidized powder through the hose 16 to the hand gun 10. Normally, the pressure of the compressed gas applied to the hand gun 10 through the regulator inlet hose 19 is relatively high, such as approximately forty psi. The gas flow through the regulator valve 15, when open, and the gas flow forming the gas shield about the needle electrode 32 are at sufficiently low levels as not to affect the gas pressure in the hose 19. For example, the gas shield around the electrode 32 may require on the order of 0.2 standard cubic feet per minute of gas and the trigger controlled regulator valve 15 will pass even less gas. The downstream side of the trigger controlled regulator valve 15 has only a small vent to the atmosphere for reducing the pressure to the control circuit when the trigger 14 is released.

As previously indicated, the nozzle 25 is attached to the front barrel section 23 by threading onto a threaded portion 24 of the front barrel section 23. When the nozzle 25 is tightened onto the front barrel section 23, a rear surface 55 of the nozzle 25 blocks or closes an end to the chamber 48 in the diffuser assembly 26. This directs gas flow through the passage 50 to the chamber 52 for forming the electrode gas shield. It will be appreciated from FIG. 1 that the needle electrode 32 is normally slightly recessed into the nozzle passageway 30. In the event that the nozzle 25 should become loosened and separated from the front barrel section 23, the needle electrode 32 will be exposed. Not only will the exposed electrode 32 be dangerous to the operator, but also there is a hazard that the electrode 32 may come near or into contact with an electrically grounded object and cause a spark in a potentially explosive atmosphere. Furthermore, if the nozzle 25 should become loose or separated from the hand gun 10 during operation of the hand gun 10, a defective coating will be applied to a workpiece being coated. For this reason, the chamber 48 is extended to the front surface 49 of the support member 43. In the event that the nozzle 25 becomes loosened, gas will escape between the diffuser assembly 26 and the rear nozzle surface 55. The sizes of the passage 47 and the chamber 48 are sufficiently large such that, in the event that the nozzle 25 loosens by only one-quarter to one-half turn, an appreciable pressure drop will occur within the hose 38. This pressure drop also appears in the interlock and control gas hose 20 when the trigger 14 is squeezed. The control circuit is designed such that the lower pressure is inadequate for turning on the high voltage power supply and for energizing the powder pump which delivers the fluidized particulate coating material through the hose 16 to the hand gun 10. Therefore, an operator cannot accidentally turn on the high voltage power supply while the nozzle 25 is removed for cleaning or when the nozzle 25 is loose through accident or carelessness. Furthermore, if the nozzle 25 becomes loosened during operation of the hand gun 10, the high voltage and the powder supply are immediately shut down to prevent a defective deposition of the powder coating on a workpiece.

Figure 4:
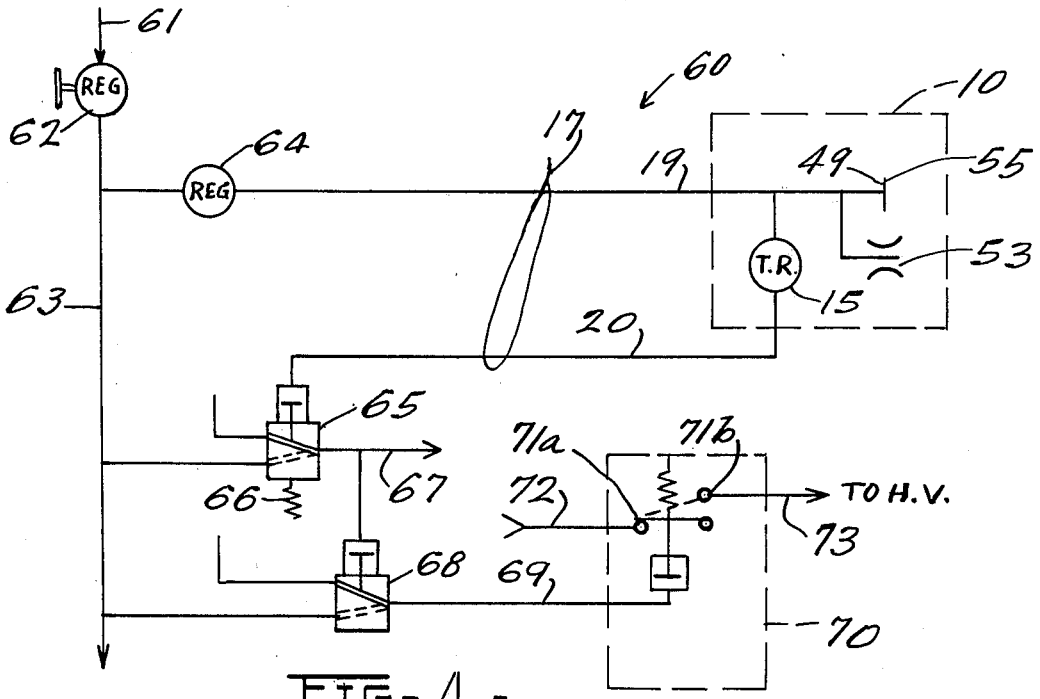
FIG. 4 is a schematic flow diagram of a portion of a pneumatic control circuit showing a safety interlock circuit for the hand gun of FIG. 1.

Turning now to FIG. 4, a portion of a control circuit 60 is shown for operating the hand gun 10 of FIG. 1. A suitable high pressure gas source, such as a compressor, is connected through a line 61 to a main pressure regulator 62. The controlled output from the main pressure regulator 62 is connected to a main gas line 63 which supplies gas for control purposes for the hand gun 10 and for fluidizing and pumping the powdered or particulate coating material to the hand gun 10. The main gas line 63 is connected through a regulator 64 to the regulated gas inlet hose 19 in the conduit 17 which connects to the hand gun 10. The regulator 64 is set to a predetermined pressure, such as 40 psig., to supply gas to the trigger controlled regulator valve 15 and to the annular passage 53 in the diffuser assembly 26 for forming the gas shield about the electrode 32. In addition, gas is supplied under pressure to the interface between the front surface 49 of the support member 43 and the rear surface 55 of the nozzle 25. As previously indicated, the trigger controlled regulator valve 15 has an output connected to the interlock and control gas hose 20 in the conduit 17. The hose 20 is connected to actuate a valve 65. Normally, a spring 66 maintains the valve 65 in a closed position, wherein an outlet line 67 is connected to the atmosphere. When sufficient gas pressure occurs within the hose 20 to overcome the force of the spring 66, the valve 65 is opened to connect the outlet line 67 to the main gas line 63. Thus, actuating the trigger to open the regulator valve 15 normally causes the valve 65 to become opened.

When the valve 65 is opened, the increased pressure on the outlet line 67 is applied to open a valve 68 which connects a hose 69 to the main gas line 63. The hose 69 is connected to a pneumatically actuated relay or switch 70. The switch 70 has a pair of contacts 71*a* and 71*b* which are closed or connected together when gas pressure is applied on the line 63. Closing the contacts 71*a* and 71*b* connects a suitable voltage source attached to a line 72, such as a standard 110-volt A.C. commercial power line, to an output line 73 for energizing a high voltage power supply (not shown). Thus, squeezing the trigger 14 on the hand gun 10 directly opens the valve 15, which in turn opens the valves 65 and 68 to close the switch 70. In the event that the nozzle 25 becomes loosened on the front barrel section 23 of the hand gun 10, gas escapes between the surfaces 49 and 55 between the diffuser assembly 26 and the nozzle 25 to reduce the pressure in the line 20. The lower pressure is insufficient to actuate the valve 65 and the valve 68 will then disconnect the hose 69 from the main gas line 63 to open the switch 70. This immediately removes high voltage from the needle electrode 32 in the hand gun 10. The outlet line 67 from the valve 65 may also operate any number of other valves having an input connected in parallel with the valve 68. These valves may be used, for example, for controlling a powder pump or other suitable type of pneumatic material feeder and, when used, for controlling vortex gas supplied to the hand gun 10. A suitable pneumatic material feed system for supplying the particulate material to the hand gun 10 is shown, for example, in U.S. Pat. No. 3,740,612 which issued to William D. Gauthier et al on June 19, 1973, and the disclosure in such patent is incorporated herein. This patent discloses details of a pneumatically controlled system for the electrostatic deposition of powdered coating materials on a workpiece. Details are shown for a reservoir for holding and forming a fluidized bed of the powdered coating material and for a pneumatic pump for feeding the fluidized material to the hand gun.

Figure 5:
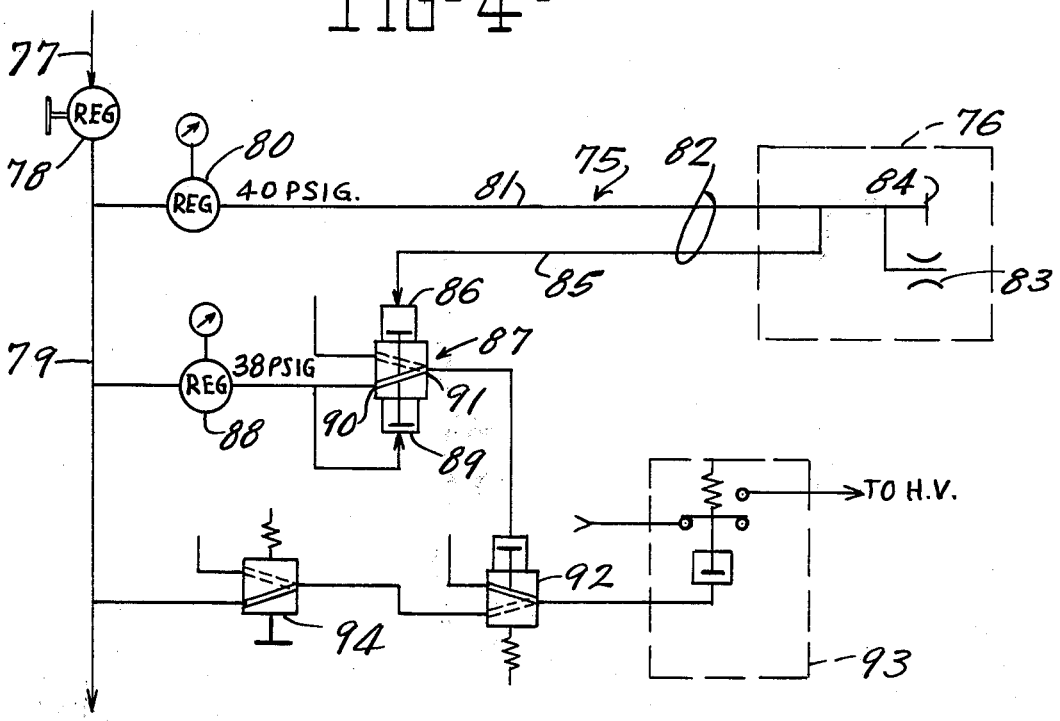
FIG. 5 is a schematic flow diagram of a portion of a pneumatic control circuit showing a safety interlock circuit for an automatic electrostatic spray gun for the deposition of powdered coating materials.

Turning to FIG. 5, a portion of a control circuit 75 for an automatic spray gun 76 for the electrostatic deposition of powdered coating materials on a workpiece is shown. The spray gun 76 is similar to the hand gun 10 shown in FIG. 1, except that the handle 13, the trigger 14 and the trigger controlled regulator valve 15 are eliminated. The spray gun 76 is permanently mounted on a suitable support for aiming the discharged sprayed material towards a workpiece, such as an article moving on a production line conveyor. A suitable compressed gas source (not shown) is connected through a hose 77 and a main pressure regulator 78 to a main gas line 79. The main gas line 79 is connected through a regulator 80 to a regulated gas inlet hose 81 which leads through a conduit 82 to the spray gun 76. The regulated gas inlet hose 81 supplies gas to an annular passage 83 surrounding a high voltage needle electrode for forming a gas shield about such electrode to prevent any coating material buildup thereon. The pressurized gas supplied in the hose 81 is also applied to an interface 84 between the housing for the spray gun 76 and a nozzle or spray cap screwed onto the spray gun housing. As long as the nozzle is tightly attached to the housing, the interface 84 is blocked to prevent gas passage. If, however, the nozzle loosens by about one-quarter to one-half turn, there is sufficient gas leakage at the interface 84 to appreciably reduce the gas pressure in the spray gun 76. A connection is made from adjacent the interface 84 and the passage 83 to an interlock gas hose 85 which supplies interlock gas to the control circuit 75. The interlock gas hose 85 is connected to one side 86 of a pressure differential sensing valve 87. The main gas line 79 is connected through a pressure regulating valve 88 to a second side 89 of the pressure differential sensing valve 87 and also to a main gas input 90 to the valve 87. The valve 87 compares the pressures on the two sides 86 and 89. Normally, the regulator 88 is set to about 2 psig below the setting of the regulator 80, or to 38 psig. As long as the spray gun 76 is operating correctly, 40 psig will be applied through the hoses 81 and 85 to the side 86 of the valve 87 and 38 psig will be applied to the side 89. Under these conditions, the valve 87 connects the main gas inlet 90 to a gas outlet 91. However, if the nozzle on the spray gun 76 should loosen sufficiently to permit gas to escape at the interface 84, the gas pressure in the hose 85 will drop below 38 psig and the pressure differential sensing valve 87 will change states to disconnect the gas inlet 90 from the gas outlet 91.

While gas is applied to the gas outlet 91 from the valve 87, a valve 92 is opened to connect a pneumatic switch or relay 93 to a valve 94. The valve 94 normally connects the main gas line 79 to the input to the valve 92. The valve 94 functions as a manual or automatic switch for turning off the high voltage power supply for the spray gun 76. When the valve 94 is in its normally open position and the valve 87 applies pressure to the outlet 91 to open the valve 92, the switch 93 will be closed to connect the high voltage power supply to a power source, such as a commercial power line. When either the valve 94 is manually closed or pressure drops in the hose 85 to cause the valve 87 to close, the switch 93 will be opened to disconnect the high voltage power supply from the power source. As with the embodiment shown in FIG. 4, the output from the valve 87 may also be used for controlling other valves, for example, a valve which controls the delivery of fluidized particulate coating material to the spray gun 76. The valves 92 and 94 are of a conventional design while the valve 87 may consist of a Model 1044 pressure repeater manufactured and sold by Northeast Fluidics, Inc. of Bethany, Connecticut, for example. Of course, it will be appreciated that other known pressure differential sensing valves may also be used for the valve 87.

Although specific embodiments of a spray gun incorporating the present invention have been disclosed and described, the safety interlock of the present invention may be adapted to other known spray gun designs for disconnecting at least the high voltage power supply and, preferably, also for turning off a material supply or feed system, in the event that a nozzle on an electrostatic spray gun becomes loose. For example, the interlock may be adapted to various prior art electrostatic spray guns for the deposition of either a liquid coating material or a fluidized particulate coating material. It will also be appreciated that various other modifications and changes may be made in the above-described preferred embodiments without departing from the spirit and the scope of the following claims.

What I claim is:

1. An improved electrostatic spray gun for the deposition of a coating material on a workpiece comprising, in combination, a nozzle having a passage for emitting a flow of the coating material toward the workpiece, a housing, means releasably attaching said nozzle to said housing, means for supplying a flow of the coating material through said housing to said nozzle passage, means for electrostatically charging the material emitted from said nozzle passage, means for supplying gas at a predetermined high pressure to a passage having an end closed by said nozzle when said nozzle is attached to said housing, the pressure of such gas in said passage decreasing when said nozzle is loosened on said attaching means, means for sensing a drop in the pressure of such gas in said passage to below a predetermined low pressure lower than said predetermined high pressure, and means responsive to said pressure sensing means sensing a pressure drop to below said predetermined low pressure for interrupting said charging means from charging the coating material.

2. An improved electrostatic spray gun, as set forth in claim 1, and further including means responsive to said pressure sensing means sensing a pressure drop to below said predetermined low pressure for interrupting said material supplying means from supplying a flow of the coating material to said nozzle passage.

3. An improved electrostatic spray gun, as set forth in claim 2, and further including valve means for normally maintaining the gas pressure sensed by said pressure sensing means below said predetermined low pressure, and trigger means for manually actuating said valve means to cause said pressure sensing means to sense the gas pressure in said passage.

4. An improved electrostatic spray gun, as set forth in claim 1, and further including valve means for normally maintaining the gas pressure sensed by said pressure sensing means below said predetermined low pressure, and trigger means for manually actuating said valve means to cause said pressure sensing means to sense the gas pressure in said passage.

5. An improved electrostatic spray gun for the deposition of powdered coating material on a workpiece comprising, in combination, a nozzle having a passage for directing a fluidized flow of the powdered coating material toward the workpiece to be coated with the material, a housing, means releasably attaching said nozzle to said housing, means for supplying a fluidized flow of such powdered material through said housing to said nozzle passage, a diffuser assembly having a charging electrode projecting therefrom, said diffuser assembly having support means clamped between said nozzle and said housing for holding said charging electrode centered in the path of the fluidized powdered material passing through said nozzle passage, said support means having a passage extending between said housing and said nozzle, means for applying compressed gas through said housing to said support means passage, said diffuser assembly including means for forming a gas shield around said charging electrode from a limited flow of the compressed gas from said support means passage to prevent a buildup of the powdered coating material on said charging electrode, the compressed gas in said support means passage normally having a predetermined high pressure, means for applying a high voltage to said charging electrode for imparting an electrostatic charge to the powdered material flowing through said nozzle passage, and means responsive to a drop in the predetermined high gas pressure in said support means passage for interrupting said high voltage applying means, whereby the high voltage on said charging electrode is interrupted when said nozzle loosens from said housing.

6. An improved electrostatic spray gun, as set forth in claim 5, and further including means responsive to a drop in the predetermined high gas pressure in said support means passage for interrupting said material supplying means.

7. An improved electrostatic spray gun, as set forth in claim 6, and further including a trigger attached to said housing, and trigger actuated valve means located within said housing between said support means and said pressure responsive means for manually controlling said high voltage applying means and said material supplying means.

* * * * *